United States Patent [19]

Bach et al.

[11] 4,294,884

[45] Oct. 13, 1981

[54] ACRYLIC FIBER HAVING IMPROVED BASIC DYEABILITY AND METHOD FOR MAKING THE SAME

[75] Inventors: Hartwig C. Bach; Helmuth E. Hinderer, both of Pensacola, Fla.

[73] Assignee: Monsanto Company, St. Louis, Mo.

[21] Appl. No.: 157,128

[22] Filed: Jun. 6, 1980

[51] Int. Cl.[3] ..... D02G 3/00

[52] U.S. Cl. ..... 428/364; 260/DIG. 23; 260/DIG. 32; 428/372

[58] Field of Search ..... 428/364, 373, 374, 372, 428/903; 525/178, 238; 260/17.4 R, DIG. 32, DIG. 23; 8/927

[56] References Cited

U.S. PATENT DOCUMENTS

| | | | |
|---|---|---|---|
| 3,432,472 | 3/1969 | Caldwell | 8/927 |
| 3,462,238 | 8/1969 | Hirshfeld et al. | 8/927 |
| 3,607,611 | 9/1971 | Matsui et al. | 428/394 X |
| 3,622,658 | 11/1971 | Shimoda et al. | 8/927 |
| 3,846,226 | 11/1974 | Smithey | 428/373 |
| 3,963,790 | 6/1976 | Couchoud | 525/201 |

FOREIGN PATENT DOCUMENTS

| | | | |
|---|---|---|---|
| 1315471 | 5/1973 | United Kingdom | 428/372 |

*Primary Examiner*—Lorraine T. Kendell

*Attorney, Agent, or Firm*—Robert L. Broad, Jr.; John W. Whisler

[57] ABSTRACT

An acrylic fiber having improved basic dyeability and the method for making the same wherein an acrylic polymer containing a sulfonated vinyl monomer as a part thereof is dissolved in a suitable solvent to form a spinning dope and a solution of a second or additive polymer dissolved in the same solvent is added to the dope which is then spun to form fibers. The second polymer is selected from the group consisting of cellulose triacetate, polymethyl methacrylate, polyvinyl chloride, a polyamide of hexamethylenediamine with 1,1,3-trimethyl-5-carboxy-3-(p-carboxyphenyl) indane and a polyamide of hexamethylene diamine with isophthalic acid. The spin dope will contain 10 to 35 weight percent of polymer solids, with the amount of the second or additive polymer being 0.5 to 25 weight percent of the total polymer solids. Fibers spun from the dope have enhanced basic dyeability. The method is effective only when the acrylic polymer contains a sulfonated vinyl monomer as part of the acrylic polymer backbone.

3 Claims, No Drawings

ACRYLIC FIBER HAVING IMPROVED BASIC DYEABILITY AND METHOD FOR MAKING THE SAME

BACKGROUND OF THE INVENTION a. Field of the Invention

This invention relates to acrylic fibers having improved basic dyeability and methods for making the same.

b. Description of the Prior Art

It is known to use additives such as vinyl benzene sulfonate as a copolymer in making acrylic fibers, the vinyl benzene sulfonate having a dyesite which enhances the basic dyeability of the fibers. One of the disadvantages of this approach is that these additive monomers are usually expensive and it is very difficult to recover any unreacted portions of such monomers. Also, since additives of this type usually are incorporated in the acrylic polymer chain as part of the chain, the amount of such additive which can be used is limited. It would be desirable to render these sulfonate-containing acrylic fibers more easily dyeable.

SUMMARY OF THE INVENTION

An acrylic fiber having improved basic dyeability and the method for making the same wherein an acrylic polymer formed from monomers at least one of which is a sulfonated vinyl monomer is dissolved in a solvent to form a spinning dope and a second, non-acrylic additive polymer selected from the group consisting of cellulose triacetate, polymethylmethacrylate, a polyamide of hexamethylenediamine with 1,1,3-trimethyl-5-carboxy-3-(p-carboxyphenyl) indane, polyvinyl chloride and a polyamide of hexamethylene diamine with isophthalic acid dissolved in the same solvent is added to the spin dope, which is then spun to form fibers. These fibers have enhanced basic dyeability.

DETAILED DESCRIPTION OF THE INVENTION

In this invention, an acrylic polymer of a known type having pendant sulfonate groups as part of the polymer chain is dissolved in a solvent such as dimethylacetamide or dimethylformamide, preferably dimethylacetamide, to form a spinning solution or dope. A second, non-acrylic additive polymer, dissolved in the same solvent, is added to the spin dope which is then spun by a wet spinning process to form fibers. These fibers have enhanced basic dyeability. It is essential that the acrylic polymer contains a sulfonated vinyl monomer as a part of the polymer chain, since the additive polymer has no effect in the absence of such a sulfonated monomer.

The action of these additive polymers in increasing dyeability is not fully understood. Increased dyeability is not traceable to a more porous fiber structure of greater surface area. In fact, most fibers of this invention have a more dense structure and a smoother surface than fibers not containing the additive polymers. It is believed that the use of these polymers somehow partially disrupts the acrylic fiber morphology, thereby making the dyesites more accessible.

The acrylic polymer is formed from monomers of which at least 35 weight percent is acrylonitrile and preferably at least 85 weight percent and a minor portion is a known sulfonated vinyl monomer which provides the pendant sulfonate groups. The amount of sulfonated vinyl monomer will be about 1–10 weight percent, based on polymer weight. The preferred sulfonated vinyl monomer is sodium sulfophenyl methallyl ether. Comonomers such as vinyl acetate, vinyl bromide and vinylidene chloride and others may be used to make up the balance of the acrylic polymer. These and other monomers copolymerizable with acrylonitrile are well known.

The additive polymers are dissolved in a solvent, preferably the same solvent used to dissolve the acrylic polymer, to form a solution which is then added to the spin dope. The additive polymers are used in amounts such that the spin dope will contain 0.5 to 25 weight, based on total polymer weight, of the additive polymer, and preferably 3 to 15 weight percent. After the solution of the additive polymer is added to the spinning dope, the dope is extruded in a conventional manner to form acrylic fibers which will have an improved basic dyeability. The acrylic and additive polymers may also be dissolved together in the same solvent.

The additive polymer is present in the spin dope and in the spun fiber as a separate, discrete phase and is dispersed throughout the dope and the fiber.

The additive, or second polymer, is selected from the group consisting of cellulose triacetate, polymethylmethacrylate, polyvinyl chloride, a polyamide of hexamethylene diamine with 1,1,3-trimethyl-5-carboxy-3-(p-carboxyphenyl) indane and a polyamide of hexamethylene diamine with isophthalic acid. When the polyamide of hexamethylene diamine with isophthalic acid is used, 5 percent lithium chloride is added to the dimethylacetamide for use as a solvent in dissolving this polyamide.

EXAMPLE

The fibers are formed by spinning the dope, containing about 15 to 25 weight percent of polymer, into a spinbath of about 55 percent dimethylacetamide and 45 percent water. The spun fibers are passed through a boiling water cascade while being stretched 6X and are then washed several times in hot water baths at 93° to 98° C. A conventional finish is then applied to the fibers and the fibers are then dried on steam-heated rolls. Basic dye uptake of the fibers is determined by using conventional methods. The table below shows the basic dye uptake of acrylic fibers containing the various additive polymers and includes a control fiber containing no additive polymer.

The acrylic polymers used in determining the data for the table below were made up of a blend of (a) 80 weight percent of a copolymer of 93 percent acrylonitrile and 7 percent vinyl acetate, (b) 5 weight percent of the additive or second polymer and (c) 15 weight percent of a polymer containing 84 weight percent acrylonitrile, 6 weight percent vinyl bromide and 10 weight percent sodium sulfophenyl methallyl ether.

TABLE

| Additive Polymer | Basic Dye Uptake (%) |
|---|---|
| Cellulose Triacetate | 19.8 |
| Polymethylmethacrylate | 19.2 |
| 6PI[1] | 18.9 |
| PVC | 18.7 |
| 6I[2] | 18.1 |
| None | 14.4 |

[1]Polyamide of HMD with 1,1,3-trimethyl-5-carboxy-3-(p-carboxyphenyl indane.
[2]Polyamide of HMD with isophthalic acid. For this blend DMAc/5% LiCl was used as the solvent.

It will be noted that the basic dye uptake of the fibers containing none of the additive polymer is significantly lower than that of those fibers containing the additive polymers of this invention.

What is claimed is:

1. A wet spun fiber composed of an acrylic polymer formed from monomers at least one of which is a sulfonated vinyl monomer, wherein said polymer contains 0.5 to 25 weight percent of an additive polymer dispersed therein, said additive polymer being selected from the group consisting of cellulose triacetate, polymethyl methacrylate, polyvinyl chloride, a polyamide of hexamethylenediamine with 1,1,3-trimethyl-5-carboxy-3-(p-carboxyphenyl) indane and a polyamide of hexamethylenediamine with isophthalic acid.

2. The fiber of claim 1 wherein the additive polymer is polymethyl methacrylate.

3. The fiber of claim 2 wherein the amount of additive polymer is 3 to 15 weight percent of the fiber.

* * * * *